United States Patent [19]

Glennan

[11] 4,051,760

[45] Oct. 4, 1977

[54] SHEARING APPARATUS

[76] Inventor: Michael John Glennan, 8 Congewoi Road, Mosman, Sydney, Australia, 2089

[21] Appl. No.: 592,800

[22] Filed: July 2, 1975

[30] Foreign Application Priority Data

| | | |
|---|---|---|
| July 4, 1974 | Australia | 8084/74 |
| July 22, 1974 | Australia | 8283/74 |
| Apr. 14, 1975 | Australia | 1229/75 |
| June 5, 1975 | Australia | 1882/75 |

[51] Int. Cl.[2] ..... B26B 19/24

[52] U.S. Cl. ..... 83/801; 83/925 R; 30/198; 30/205

[58] Field of Search ..... 30/194, 197, 198, 201, 30/202, 203, 205, 140; 83/701, 801

[56] References Cited

U.S. PATENT DOCUMENTS

| | | | |
|---|---|---|---|
| 81,210 | 8/1868 | Reid | 30/205 |
| 1,509,787 | 9/1924 | Smith | 30/202 |
| 3,145,607 | 8/1964 | Geary | 83/701 X |

*Primary Examiner*—Willie G. Abercrombie
*Attorney, Agent, or Firm*—Holman & Stern

[57] ABSTRACT

An improved cutting unit for incorporation in a sheep-shearing apparatus having a flexibly curvable comb which conforms to the curved contours of an animal's body, thereby enabling a larger area to be fleeced at any one stroke, whether the apparatus is manually operated, power driven, or is an automatic or high speed fleecing machine.

22 Claims, 10 Drawing Figures

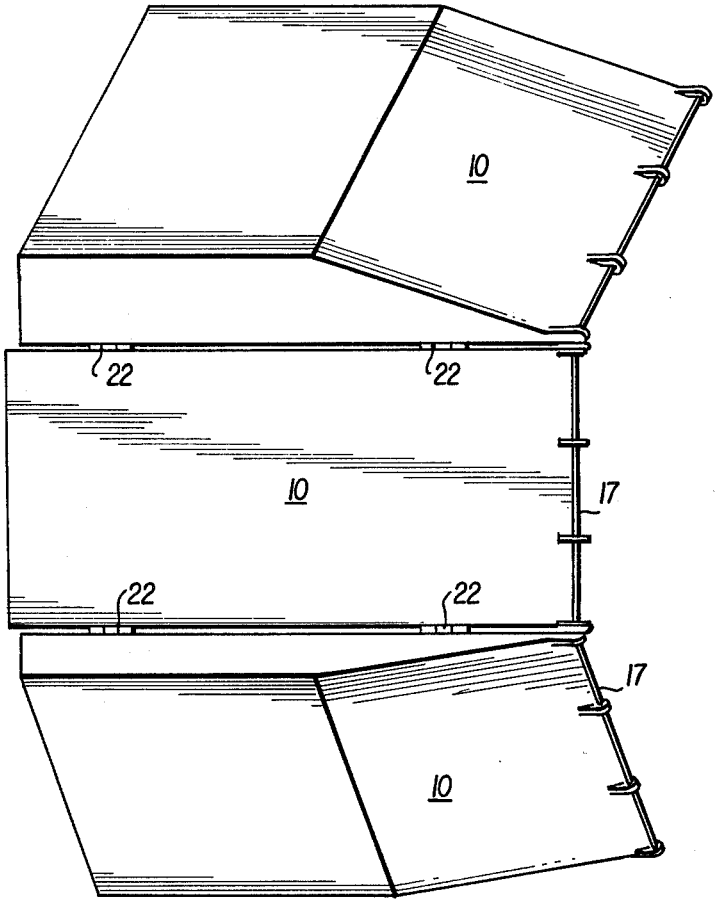
FIG. 2
FIG. 4
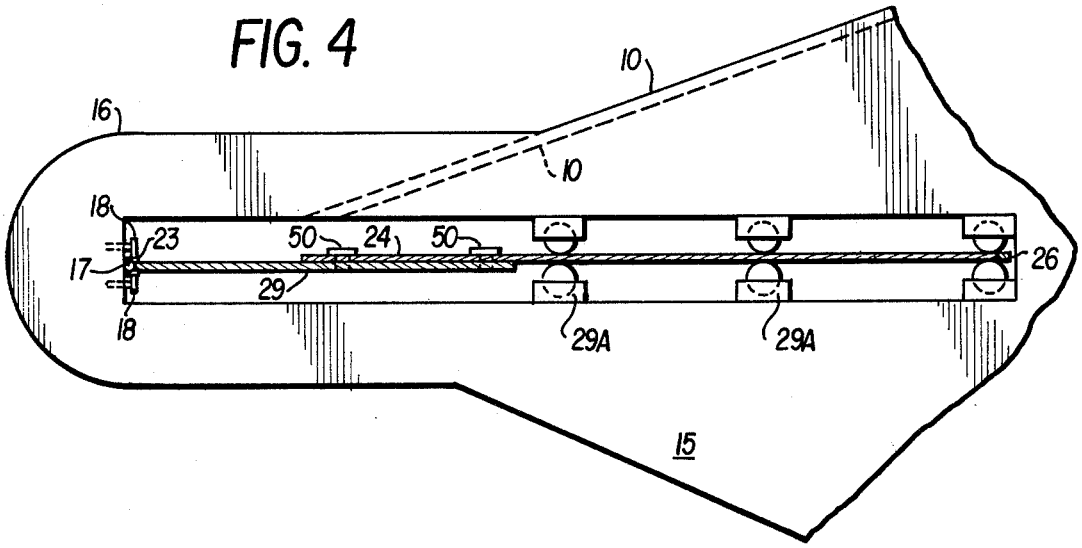

SHEARING APPARATUS

The present invention relates to an improved fleece breaking cutting or severing unit for use in manually propelled, power propelled, automatic or high-speed and to shearing apparatus for shearing animals such as sheep and to shearing apparatus of all the above types incorporating therein such a fleece breaking, cutting or severing unit.

Hitherto known animal shearing apparatus has comprised a manually operated handpiece, the cutting unit thereof comprising power-driven cutter teeth, normally three such teeth, the hand-piece usually employing a rigid comb, the underneath surface of which came in contact with the animal's hide, the cutter teeth oscillating laterally in a flat plane relative to the forward movement of the shearing apparatus and in contact with the upper surface of the comb teeth. The comb and the cutter teeth ideally were set so that the comb teeth separated, adjusted and presented the wool fibres in such a way along the gullets of the comb teeth and thence between the cutter teeth that the fibres were severed at the point of intersection of the cutting edges of both comb and cutter as the cutter, while in contact with the upper surface of the comb teeth, oscillated from one side of the comb to the other, the cutting edges of the comb being located on the upper edges of the comb teeth, the cutting edges of the cutter being located on the lower edges of the cutter teeth. A forward progressive cutting action i.e. a cutting stroke or cutting blow was achieved by the foreward movement of the handpiece as it was impelled forward by the shearer's hand, the wool or fleece fibers being compressed tightly together in "V" shaped gullets between the teeth of the comb, so that as the power driven cutter teeth oscillated in contact with the upper surface of the comb, the fleece was continuously severed during the course of the fleecing stroke or blow, but leaving a small residue of fleece still attached to the animal's hide, the length thereof depending upon the distance between the upper and lower surfaces of the comb teeth.

By reason of the fact that the cutter teeth of the prior apparatus could only achieve a severance of the fleece by a lateral cutting action or movement in a flat plane relative to the forward movement of the shearing apparatus, the natural curvature of the animal's body limited to a maximum of four inches or thereabouts the cross sectional width of each cutting or fleecing stroke which is capable of being practically achieved. Where the width of the cutting or fleecing stroke of the prior shearing apparatus exceeded that width, the projecting point of either or both of the outside teeth of the comb would either come in direct contact with and injure the animal, or the cutting stroke, by reason of its excessive width in relation to the natural curvature of the animal's body, would cut laterally into and thereby damage the fleece by preventing an even severance of the fleece from the animal's body i.e. a severance free from "double cuts". The practical limitation on the width of the cutting or fleecing stroke of the prior shearing apparatus had the result that numerous strokes are required to shear a given area of the animal's hide and, for example, even skillful and experienced shearers required up to 2 minutes or more to shear a sheep.

The object of the present invention is to provide an improved cutting unit for incorporation in a shearing apparatus, which cutting unit is adapted to conform to the curved contours of an animal's body thereby enabling a larger area to be fleeced at any one stroke than was hitherto possible, whether the apparatus is manually operated, power-driven or is an automatic or high-speed fleecing machine.

The cutting unit of the present invention is suitable for use in shearing apparatus for fleecing animals whose skin is in its natural condition or whose skin and fleece is in any other condition such as, for example, the condition produced by artificially induced sub-cutaneous emphysema or by administering to the animal a suitable chemical which results in a break in the animal's fleece at an appropriate time prior to mechanical fleecing.

The improved cutting unit of the present invention and the shearing apparatus incorporating same have several advantages over hitherto known shearing apparatus.

One advantage of the cutting unit and apparatus of the present invention is that it may be adapted readily to power-operation with manual or automatic guidance of the apparatus over an animal, thereby reducing the time required to shear an animal and permitting mass shearing of animals.

Yet a further advantage of the cutting means and apparatus of the present invention is that it may be adapted readily to use in power driven, automatic, high-speed fleecing apparatus, preferably utilising an electrically heated hot wire or a laser beam to effect the actual break or severance in the animal's fleece or the fibers thereof.

To achieve the above stated objects and advantages, the present invention provides a cutting unit for a shearing apparatus, comprising a curvable comb having teeth on the intended concave surface thereof,the comb being adapted to co-operate with a cutting means located on the upper surface of the teeth of the comb, the arrangement being such that when the toothed surface of the comb is applied in a flexed condition to the body of an animal to be shorn, the comb and the co-operating cutting means conform as required to the contours of the animal's body, and when a manual or other propulsion force is applied to the shearing apparatus to propel the same over the body of the said animal, this propulsion force simultaneously assists the cutting means to break or sever the fleece from the animal's hide.

The cutting means may be in the form of a flexible cutting blade, a toothed or toothless blade, bladed cylinders, swivelling cutter blades, a hot wire or a laser. If a flexible blade or a wire, these may be of the "endless belt" type or may be affixed to an endless belt. Alternatively the blade or wire may be movably or otherwise affixed to the comb at suitable points. The principal advantage of an endless-belt blade is its ability to fleece an animal's body by means of increasing and/or reducing the length of the cutting edge between sprockets or the like tensioning means, to conform with the variation in the animal's girth as the endless-belt blade travels over, around or up an animal's body.

Any suitable cutting or severing mechanism may be attached to any suitable endless-belt to actually effect the break or severance in the fleece. One suitable mechanism is a thin flexible metal blade which itself is in the form of an endless belt and which is fixed to a suitable endless belt. Alternatively an electrically heated wire fixed by suitable means immediately in front of a suitable endless belt also provides a suitable cutting or severing means. Similarly a laser beam may be employed as the cutting or severing means and for this purpose may be fixed to the teeth of a suitable comb or attached to a suitable endless belt.

The hot-wire endless belt severs the fleece of the animal being shorn as the wire comes in contact with the fleece, the severance being achieved by the heated or hot-wire burning through the fleece on contact therewith. By this means the "hot-wire" acts as a cutting blade producing a severance of the fleece similar in result to that achieved by the flexible endless-belt type blade. The hot-wire endless-belt blade functions or moves in the same path as the endless belt blade.

Yet a further cutting means which may be used in either a manual or a high-speed fleecing apparatus according to the invention is a toothless blade having a very sharp forward cutting edge. The blade is movably fixed above a flexible comb. As the fleecing apparatus moves over the animal's hide or in the alternative, as the animal is drawn through a stationary fleecing apparatus, the unshorn fleece moves into the numerous gullets of the comb. In the conventional hand-held shearing machine the fleece is compressed into "V" shaped tufts by the corresponding "V" shape of the gullets of such machines and the fleece is severed by the cutter teeth, which are also "V" shaped, moving sideways across the comb, i.e. more or less at right angles to the forward direction of each cutting stroke of the machine.

This comb to be used in conjunction with the toothless blade of the present invention may be of any convenient shape provided it is still flexible and curvable. As the moving fleecing apparatus moves forward or, in the alternative, as the animal is drawn through a stationary fleecing apparatus, the unshorn fleece moves into the gullets of the comb until it comes in contact with the toothless blade. At this point the toothless blade severs the fleece by being drawn across the fleece more or less at right angles to the direction in which the fleece is growing vertically from the animal's hide.

The toothless blade of the invention may be attached to a fork assembly in a manner similar to that to which the cutter of the conventional hand-held machine is attached. In this form the fork assembly is caused to pivot on a fulcrum or centre post in a similar manner to the pivotting mechanism of the conventional hand-held machine.

The fork assembly may be equipped with any suitable drive mechanism which imports a sideways movement or oscillation of the toothless blade across the comb. The crankhead power driven spindle of the conventional hand-held machine may be utilised for this purpose.

In one form of the power drive of the toothless blade, the power drive is transmitted by a power-driven axle running behind the crankhead parallel to the cutting blade. The power driven axle has a gear wheel around its mid-section, the gears being set at an oblique angle in relation to the axis on which the wheel rotates. The crankhead has attached to its rearward face a further gear wheel which has its teeth thereof also set at an oblique angle in relation to the axis about which the crankhead rotates. The teeth of the gear of the crankhead mate with the teeth of the gear of the power driven wheel and by this means, as the power driven axle rotates, the crankhead rotates on an axis at right-angles thereto. The same reciprocating action of the blade across the comb is produced as in the case with the reciprocating action of the cutter of the conventional hand-held machine.

The cutting edge of the above blades (and of the blades of the bladed cylinders described below) are ideally set at an appropriate distance behind the forward face of the comb or of the projecting teeth thereof so that the same only travels a short distance into the unshorn fleece before the fleece which has entered the gullets of the comb is severed by the fleecing blade. By this means the cutting efficiency of the fleecing machine is not reduced by any excessive build-up or pressure by the unshorn fleece on the forward face of the comb as the same comes into contact with the unshorn fleece on the animal's hide as it moves into and through the fleecing machine.

The cutting means of the cutting unit of the invention may also be in the form of one or more bladed cylinders which may be mounted successively but spaced from each other in a flexible line on a flexible axle. These may be used as a separate cutting means or in combination with a flexible blade. The flexible axle may be provided for example, by incorporating one or more universal joints passing through the axis of each bladed cylinder, the flexible axle being drivable from a power source to rotate the cylinders in a clock-wise direction. Each bladed cylinder may comprise a number of cutting blades fixed to the circumference of the cylinder parallel to the axis thereof and running the full length of the cylinder and jutting out from the surface thereof at an appropriate distance and appropriate length and at an appropriate cutting angle, each cylinder preferably having the same number of blades respectively fixed in the same relative position as fixed to each other cylinder.

The invention also provides shearing apparatus incorporating a cutting unit according to the invention and also incorporating a manually or power-applied propulsion means to propel the apparatus over the animal's body.

One embodiment of a propulsion means according to the invention not only facilitates forward propulsion of the shearing apparatus but also acts to pull or draw back the hide of the animal being shorn in a direction opposite to that in which the shearing apparatus is moving, thereby assisting the cutting action of the shearing apparatus and at the same time preventing the animal's hide from forming folds or creases which otherwise might impede the steady progress of the shearing apparatus over the hide or interfere with the efficient cutting action of the apparatus.

In this embodiment of a propulsion means, a flexible line of propelling cylinders are mounted behind a flexible line of bladed cylinders, the propelling cylinders being joined together similarly to the bladed cylinders, that is spaced apart in a line mounted on a flexible axle passing through the axis of each propelling cylinder, the flexible axle being drivable from a power source to rotate the propelling cylinders on an axis parallel to the cutting edge of the bladed cylinders. The power source may comprise a conventional electric motor incorporated in the shearing apparatus, or may be a drive taken from the conventional type of insulated steel downtube drive which normally is already installed in shearing sheds to drive the prior known apparatus.

A flexible line of propelling cylinders also may be mounted behind a single flexible blade/comb embodiment, the propelling cylinders being mounted to rotate on an axis parallel to the cutting edge of the cutting means.

The shearing apparatus of the invention, under manual guidance, is caused to move forward by a forward propulsive force exerted by the power-driven rotating propelling cylinders. As the shearing apparatus of the invention moves forward in this manner, the single blade, or, if the cutting means comprises a line of bladed cylinders, each blade in turn of the rotating bladed cylinders, shears the fleece or other fiber above that section of the animal's hide over which the shearing apparatus is passing.

If a flexible line of bladed cylinders is used in combination with a flexible line or propelling cylinders, it is convenient to mount these two lines on the frame or housing of the shearing apparatus by means of brackets located at a convenient position, such as one at each end and one in the middle of the two lines, each bracket being releasably attached to the flexible axles of each line so that the axles are free to rotate and at the same time an operator's hand, left or right, is free to apply a firm downward pressure, by means of the brackets, at the three points where the brackets are mounted, to both lines of cylinders thereby ensuring that the same remain pressed against the animal's hide during each stroke of the shears. By this means the cutting blades and/or the blades of the bladed cylinders cut the wool (or other fiber) at a constant length in relation to the animal's hide depending only on the thickness or depth of the comb.

At the point where the blades come closest to the animal's hide (at which point the blades also come closest to the comb) when the shearing apparatus is in operation and as the two lines of cylinders flex in conformity with the curvature of the animal's body, the extremities of each blade on each side of each cylinder (except for the cylinder at each end of the line of cylinders) rotate in close proximity to the extremity of the blades of the adjoining cylinders, but leaving a small gap which varies in width according to the varying degrees of curvature of the animal's body.

The small gap of varying width between the extremities of the blade of each bladed cylinder leaves a narrow section of wool of varying width which is not shorn by the cylinder blades but which, instead, is shorn by a series of fixed blades attached to the comb just in front of the bladed cylinders and which fixed blades shear those sections not cut by the cylinders in the same manner as the single blade embodiment.

The bladed cylinders may be attached by one or more small belts to a power source which provides a mechanical force which turns the bladed cylinders at a speed which most effectively shears the wool as the shearing apparatus of the invention moves forward over the animal's hide.

The propelling cylinders, which provide the main propelling force for the bladed cylinders, may be attached to the flexible curvable comb just behind the bladed cylinders in a line parallel to the line of the bladed cylinders by means of the aforementioned brackets. Preferably the width of each bladed cylinder is equal to the width of each propelling cylinder.

Each propelling cylinder may be made from flock, bristles, or may be provided with a large number of pointed, flexible protuberances or fingers which protrude through the spaces between the teeth of the comb into the freshly cut wool (or other fibre) remaining after the cutting blade or blades have passed over that section of the blades. The propelling cylinders may in fact be made from any suitable material which will give traction on the fleece.

Forward traction is provided to the shearing apparatus by the forward momentum which results from the contact at the point closest to the animal's hide on the circumference of the continously forward rotating propelling cylinders, at which point the propelling cylinders contact and obtain traction from either the fleece remaining attached to the animal's hide after the cutting means of the apparatus has moved forward of the point with which the forward rotating propelling cylinders are in contact at any one point of time, or obtain traction from direct contact with the animal's hide i.e. at the same relative position in relation to the propelling cylinders.

The propulsion means as embodied by the propelling cylinders acts as a means of substantially assisting or providing power for the forward movement of the shearing apparatus of the invention in both a manually controlled form and in an automatic or high-speed form to be hereafter described.

Conveniently the shearing apparatus of the invention may be provided with a speed regulating device which may be readily operated by the user whilst the shearing apparatus is in operation thereby permitting the speed of forward movement of the apparatus to be regulated to the most efficient shearing speed.

Because the bladed cylinders and the propelling cylinders are provided with flexible axles and are mounted in a flexible line with consequent ability to conform laterally to the contours of the animal being shorn, it is possible with the apparatus of the present invention to make use of the entire cutting area of the apparatus and with each stroke thereof to shear the animal's hide over a broader area than has hitherto been possible with known apparatus. It is also envisaged in the present invention to connect in series a number of the above described shearing apparatuses, which may be coupled together side by side so that an even greater area of wool or other fleece may be shorn with each stroke of the apparatus over the animal's hide.

In yet a further embodiment of the present invention an automatic shearing apparatus is provided incorporating one or more of the previously described shearing apparatuses of the invention. In this embodiment animal holding means are provided to hold the animal being shorn as immobile as possible during the shearing operation. Once immobilised, one or more moving arms incorporating in its or their free end or ends a shearing apparatus according to the invention, is/are brought against the various portions of the immobilised animal to shear same. The arm or arms may be guided automatically or by manually operable levers. The arm or arms push or pull the shearing apparatus according to the invention across the animal's hide.

A sufficient number of arms incorporating the shearing apparatus of the invention may be used simultaneously at different points of the one animal so that the animal is completely shorn in a very short time. A number of animals may be shorn simultaneously by providing a row of stalls each provided with holding and immobilising means and serviced by a number of moveable arms each provided at the free end with a shearing apparatus according to the invention.

Any practical number of shearing apparatus according to the invention may be coupled together in the manner above described to produce any desired length of forward or cutting edge in the apparatus.

One manually propellable shearing apparatus according to the invention will now be described in more detail. In this embodiment an entirely manually operable shearing apparatus comprises a flexible, curvable comb having teeth provided on the intended concave surface thereof, the teeth being spaced from each other so that when the comb is fully flexed in use the free ends of the teeth do not overlap one another. A flexible cutting blade of substantially the same length as the comb is fixed thereto at a position behind and adjacent the teeth but near the top of the teeth. The comb and cutting blade may be contained in a frame or housing if desired, and either on top of the housing or on top of the comb directly, straps or more similar device may be provided into which the flat of a user's hand may be inserted, with the thumb extended, so that the shearing apparatus is firmly and securely held by the flat of the user's hand, either left or right. When so held the end of the thumb holds one end of the apparatus and the first, second and third fingers hold the outer end of the apparatus.

In its mid-section the apparatus of the invention extends back into the flat, open palm of the user's hand and in so doing the palm of the hand together with the extended thumb and the extended first, second and third fingers on each side of the palm are able to apply both a forward and downward driving force to the apparatus which, because of its flexibility, bends with the natural curvature of the animal's body so that the whole width of the cutting blade is utilised in each cutting stroke of the apparatus. By this means the apparatus is used to shear an animal in a similar manner to existing apparatus except that the area shorn with each stroke of the present apparatus is several times greater than with existing apparatus using poser-operated blades. Further, the power needed to operate the cutter teeth of the prior apparatus is eliminated with the above described embodiment of the present invention, although if desired for any reason, the apparatus of this embodiment may be power-operated in a manner similar to the embodiments described hereafter.

The cutting efficiency of the blades is increased, especially where the apparatus of the invention is used in high-speed fleecing apparatus, where the skin of the animal has been stretched by the animal's body having been suitably positioned or held for the application or operation of the fleecing apparatus to which the blades are attached.

Ideally the animal's body is suspended with its spine in a vertical position off the ground with its head also pointing upwards vertically so that the neck is fully outstretched or extended. With the animal in this position the fleecing apparatus moves vertically upwards from underneath the animal up to and over its hind quarters, along its body to its head. The advantage of this position are further described hereunder.

To increase the severing efficiency of the blades a break in the animal's fleece may be produced by the administration to the animal of a suitable chemical for that purpose at an appropriate time prior to the fleecing operation, i.e. the separation of the fleece from the animal's body. In this latter case the fleecing blades are utilised as the means of actually separating the fleece from the animal's body.

The severing or cutting efficiency of the blades may also be increased by the animal's skin having been placed in a taut or distended condition by extensive sub-cataneous emphysema having been induced in the animal by any suitable means.

Where the animal to be fleeced is suspended off the ground from a mouth plate (of the type described in my co-pending application PB 9148/74) or muzzle, and from leg stirrups, so that the fleecing apparatus fleeces the animal's body by moving upwards in a vertical direction, the severance of the fleece is achieved by utilising the following factors:

a. the downward pulling force exerted on the skin by the force of gravity;
b. the downward drawing or pulling force exerted on the skin by the propelling cylinders; and
c. the stretching of the animal's skin particularly in the neck region by the head being held pointing vertically upwards; and
d. (optionally) by extensive and generalised substaneous emphysema being induced or produced in the animal.

The cutting or fleecing efficiency of each type of cutting blade is substantially increased where the direction of the fleecing stroke of the blades is vertically upwards in direction. This is due to the downward gravitational force which constantly pulls the skin of the animal in a downward direction.

Ideally, the animal to be fleeced is placed in a position where the fleecing blades move upwards in a vertical direction to fleece the animal's body. This position also assists the pulling or drawing of the animal's skin or hide through the comb by the propelling cylinders and hence assists in reducing the tendency of the skin to pucker or form folds which might otherwise obstruct the passage of the fleecing blades.

In order to further exemplify the invention several embodiments thereof will now be described with reference to the accompanying drawings wherein:

FIG. 2 is a view of three of the apparatuses of FIG. 1 joined together;

FIG. 4 is an enlargement of a comb window;

Figure 1:
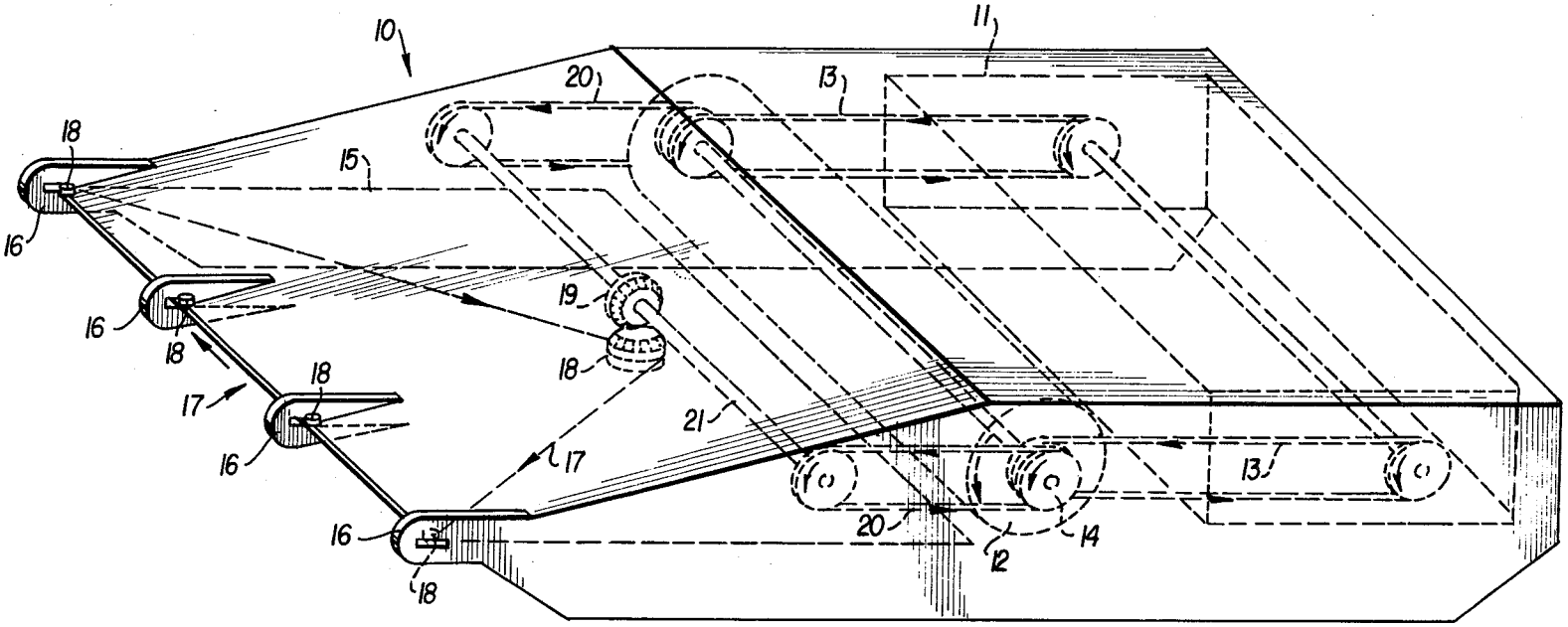
FIG. 1 is a perspective view of a shearing apparatus according to the invention, incorporating a hot wire cutting means.

Referring now to the embodiment shown in FIG. 1 a housing 10 has mounted therein a motor 11 which drives a propelling cylinder 12 by means of belts 13 passing around the axle 14 of the cylinder 12. A flexible curvable comb 15 having teeth 16 is mounted in the housing 10 so that the teeth 16 project therefrom and a rotating hot-wire blade 17 passes through the teeth 16 and is driven by pulleys 18 of sufficient number and strength to hold the hot wire 17 to the desired tension, the pulleys 18 being driven by a driving sprocket 19 which in turn is driven from the motor 11 by means of belts 20 turning a spindle 21.

The hot-wire blade 17 is continually moving laterally across the fleece in a slicing stroke as the wire 17 rotates around the pulleys 18. In the course of this movement of the hot-wire 17, the heat lost from the hot-wire in severing the fleece is being continually made good as the hot-wire continuously leaves the fleece and travels into and through the housing 10 and back again through the teeth 16 of the comb 15 as the slicing stroke continues.

The electricity which causes the hot-wire 17 to become heated to the desired temperature is supplied by means of a conductor from any power source convenient to the housing 10 and thence to any convenient point of contact with the continuously rotating hot-wire 17. Any one or more pulleys 18 provide a suitable point of contact for the electric power for that purpose.

The propelling cylinder 12 not only assists the forward propulsion of the apparatus over the fleece of an animal being shorn, but also assists in drawing or pulling of the fleece through and then away from the cutting mechanism, the hot-wire 17.

FIG. 2 shows three typical hot-wire rotating blade units of FIG. 1 joined together in a suitable manner to fleece an animal. Depending on the part of the animal's anatomy to be fleeced any convenient number of such blade units may be joined together by any convenient means. One such means are the hinges 22 as shown in FIG. 2.

Figure 3:
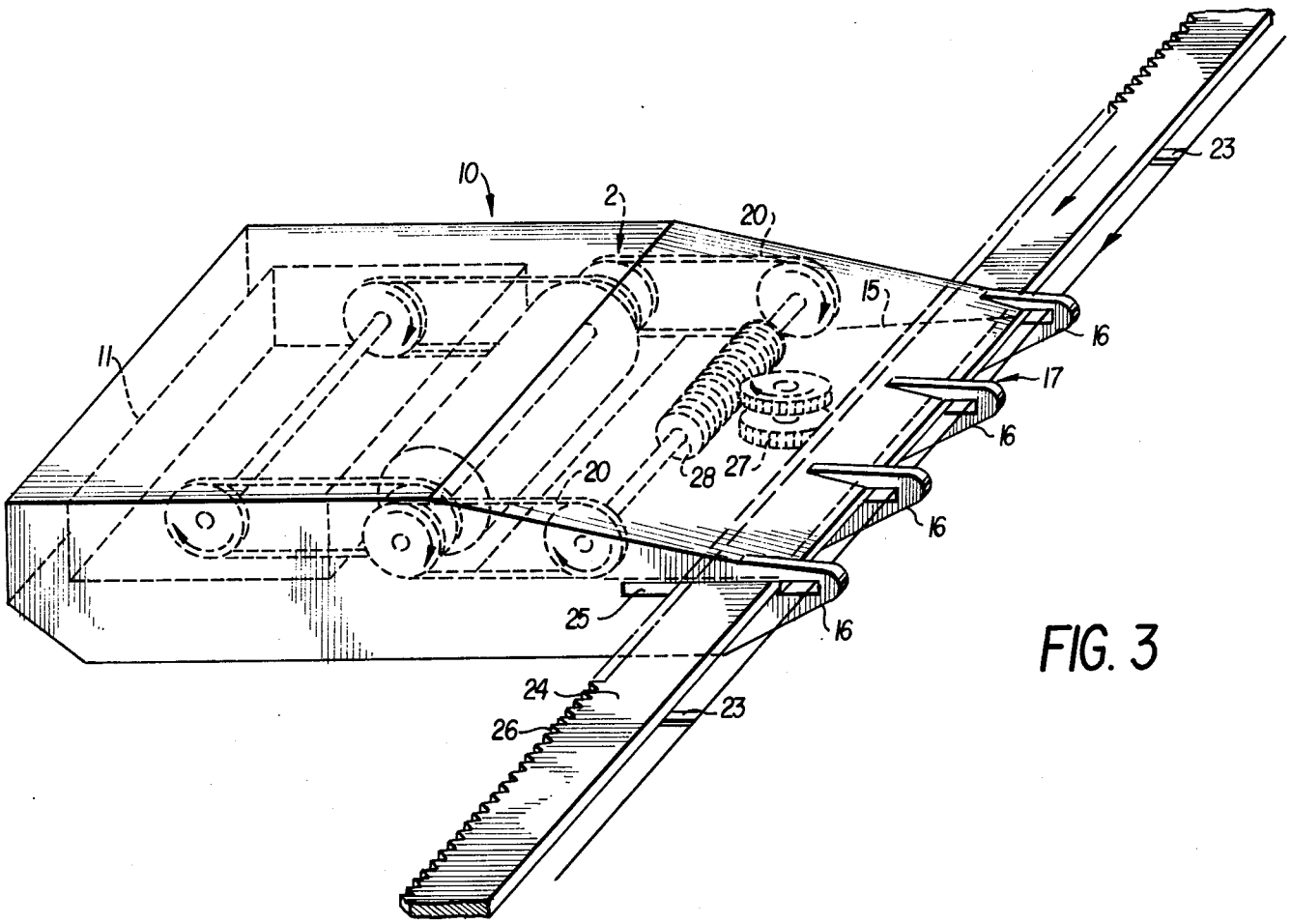
FIG. 3 is a view of a shearing apparatus of the invention wherein the cutting means is a hot-wire endless belt.

Referring now to the embodiment shown in FIGS. 3 and 4, instead of a rotating hot-wire blade, a hot-wire 17 is mounted on an endless-belt 24 by means of lugs 23, the whole of which passes through windows 25 in the housing 10. The endless belt 24 is toothed with teeth 26 which engage on a driving sprocket 27 which is in turn driven from a driving cylinder 28 driven from the motor 11 by belts 20.

A finger support 29 for the hot-wire is provided and the endless belt 24 is supported in ball races 29A and secured by screws 50.

Referring now to the embodiment shown in FIGS. 5, 6, 7 and 8, this embodiment is suitable for incorporation into any high-speed fleecing apparatus and incorporates an endless belt blade 30 comprising a narrow strip of a thin resilient metal having the ability to flex and twist without distortion. One edge of the blade 30 has a very sharp cutting edge. The blade 30 is of any desired practicable length.

A blade similar to the blade 30 is presently found in certain safety razors which have a long narrow flexible rotatable blade in which at any one time part only of the full length of the blade is exposed or positioned for shaving. The remainder of the blade is wound around a sprocket or winder device. When the exposed section of the blade has become blunt the winder is manually turned so as to wind or move a new section of the blade into position for shaving. However, the blades of such razors rotate through one complete revolution only, whereas the blade the subject of this invention, by having its two ends joined together, continually rotates as an endless belt in the manner hereafter described, and is power-driven.

The blade 30 has cut into its surface, serrations or perforations which correspond with the teeth of rotating sprockets 32 and 33. The blade 30 moving as an endless belt, passes around or between rotating sprockets, 32 and 33 and wheels and guides (not shown) in the course of which it twists, turns and forms loops or partial loops.

The rotating sprockets 32 and 33 are attached by a driving belt, or by other suitable means (not shown) to a driving mechanism (not shown) which causes the sprockets to rotate which in turn cause the blade 30 to move around the sprockets 32 and 33.

Only one laterally moving section of the blade at any one time (called the "cutting section") comes in contact with and cuts the fleece as the blade moves (as an endless belt) around or between the sprockets in the manner above described.

The blade 30 continually moves in a constant lateral direction in relation to the forward movement of an animal 100, as it moves through the fleecing apparatus or, in the alternative, in relation to the forward movement of the fleecing apparatus along the animal's body. In so doing the cutting section of the blade 30 conforms to the angle or shape of the animal's hide. By the foregoing means the cutting section of the blade 30 cuts the fleece as it (the fleece) passes between the teeth of the comb of the high-speed fleecing mechanism. The severance of the fleece is achieved by the cutting section of the blade 30 moving in a constant lateral direction more or less at right angles to the (vertical) direction in which the fleece is growing out from the animal's hide.

Figure 5:
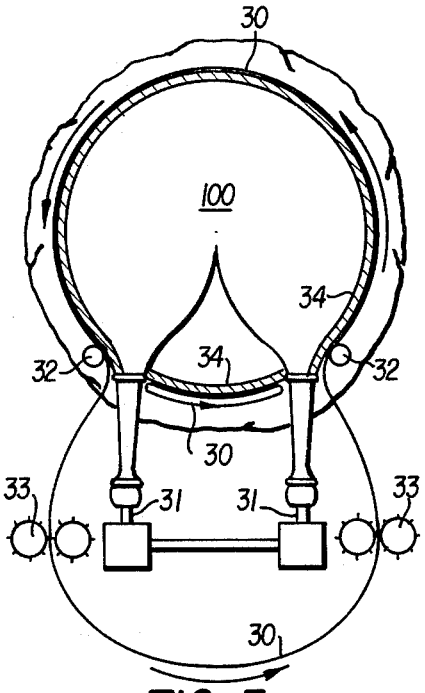
FIG. 5 is a diagrammatic view of an animal to be shorn viewed from the rear and looking vertically upwards, showing an endless belt cutting blade and flexible comb conforming to the curvature of the animal's body.

In the embodiment shown in FIG. 5, the section of the laterally moving endless-belt blade 30 which is not utilised for cutting the fleece, moves in a position in which it does not come in contact with any part of the fleece, but otherwise the position and path in which this section of the endless belt blade 30 travels at any one time is not critical.

The cutting section of the blade 30 travels on the upper surface of and at right angles to the teeth of a flexible comb 34. By this means the comb 34 acts as a safety barrier by preventing the blade 30 coming into contact with the skin of the animal 100. The depth of the teeth 16 of the comb 34 determines the length of fleece which remains on the animal's hide after fleecing. As in the case of the "toothless" blade (hereinbefore described) the comb 34 utilised in conjunction with the "endless belt" blade 30 has a gullet of any convenient size and shape. The comb 34 takes the same or a similar form for both blades and each of these blades severs the fleece at the top of the comb 34 where it travels in a constant laterl direction (in the case of the toothless blade).

The sprockets 32 and 33 about which the endless-belt blade 30 travels consist of two principal sprockets 32 and any desired practical number of subordinate sprockets 33. The principal sprockets 32 are located one at each end of the cutting section of the endless-belt blade 30. The position at any one time of the principal sprockets 32 determines the length around the animal's body of the cutting section of the endless-belt blade 30, i.e. the section of the blade the cutting edge of which at any one time severs the fleece as the blade moves laterally as a belt while at the same time moving forward along the animal's hide.

The principal sprockets 32 apply an appropriate amount of pressure at each end of the cutting section. This pressure holds the flexible comb 34 in contact with the animal's hide and at the same time continually adjusts the length of the cutting section of the blade 30 in accordance with the variation in girth or circumference of the section of the animal's body which is being fleeced at any one time.

During the fleecing operation the position of the subordinate sprockets 33 is being continually adjusted to take up any excess length of the cutting section. This is brought about by the respective distance between the various sprockets being increased or decreased accordingly.

Where the fleecing mechanism moves along the animal's body from its hindquarters to its head, the excess or unutilised length of the cutting section which results from the gradual reduction in the circumference or girth of the animal, i.e. as one moves from the hindquarters to the head, is taken up by the blade 30 travelling laterally as an endless belt in a more or less circular or oval path around and in front of the animal as shown in FIG. 5. Alternatively the excess is taken up by the length of the cutting section being reduced by the distance between the principal sprockets 32 being reduced, and the distance between the two latter sprockets 32 and the subordinate sprockets) 33 around which the blade 30 is travelling being correspondingly increased. In the latter case the section of the blade 30 other than the cutting section moves around or near the same part of the animal's body as the cutting section but in the reverse direction thereto as shown in FIG. 6.

Where the fleecing mechanism moves along the animal's body in the opposite direction to that just described, i.e. from its head to its hindquarters, the length of the cutting section of the blade increases as the circumference or girth of the animal increases. As described in the preceding paragraph, that is achieved by the continuous adjustment of the position of the sprockets 32 and 33 in relation to one another in order to continually vary the length of the cutting section. The animal 100, ideally is held in leg stirrups 31.

Figure 6:
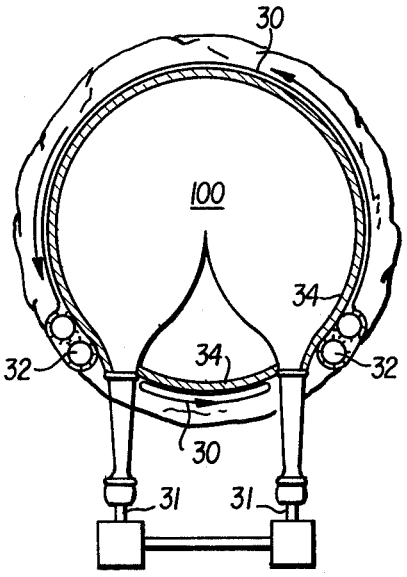
FIGS. 6, 7 and 8 are other forms of the endless belt cutting blade.
Figure 7:
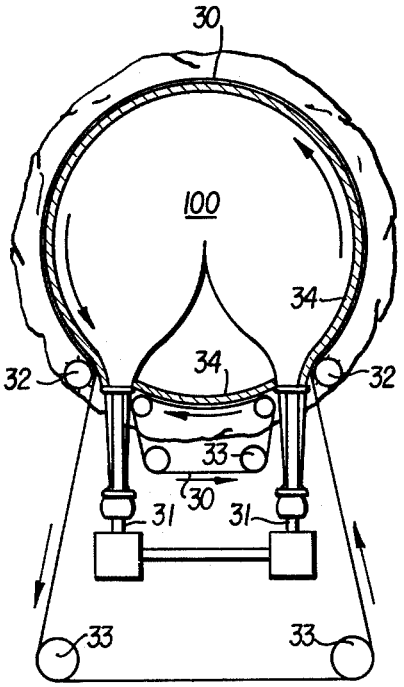
Figure 8:
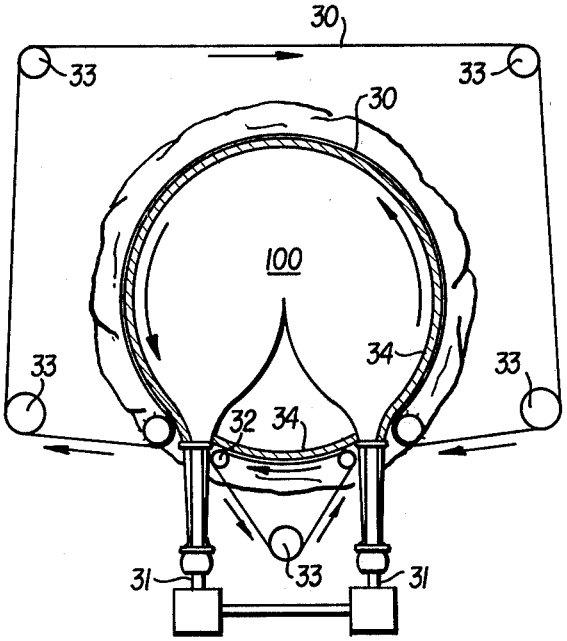

FIGS. 7 and 8 illustrate typical paths which may be followed by the endless belt 30 and also show the blade taut, i.e. under tension between the various sprockets 32 and 33 whereas in FIGS. 5 and 6 the blade is not so shown. In all the embodiments illustrated diagrammatically in FIGS. 5 to 8 inclusive, it is to be understood that a hot-wire endless belt may be substituted for the endless belt cutting blade 30.

One of the principal advantages of attaching a "hot-wire" or laser to a suitable endless belt is that as the endless-belt with the hot-wire or laser fixed thereto, travels at high speed around the various sprockets a mean or constant heat at the appropriate temperature is evenly applied in contact with the fleece, thereby achieving an even severance of the fleece as the cutting section of the endless belt (the section thereof between the principal sprockets 32) comes in contact therewith. In the case of the hot-wire endless belt, the hot-wire provides a mean or constant heat at the appropriate temperature due to the heat absorbed in the cutting section being continuously made good as the endless belt travels around the subordinate sprockets 33, and as a consequence, the heat lost in severing the fleece is being continuously made good before each fresh section of the hot-wire comes in contact with the fleece. The high speed at which the endless-belt (with the hot wire attached thereto) travels through the fleece cancels out the effect of any variations in the temperature of the cutting section of the hot wire which would otherwise occur due to naturally occuring variations in the density of the fleece. These advantages also apply to the embodiment shown in FIGS. 1 to 4.

Figure 9:
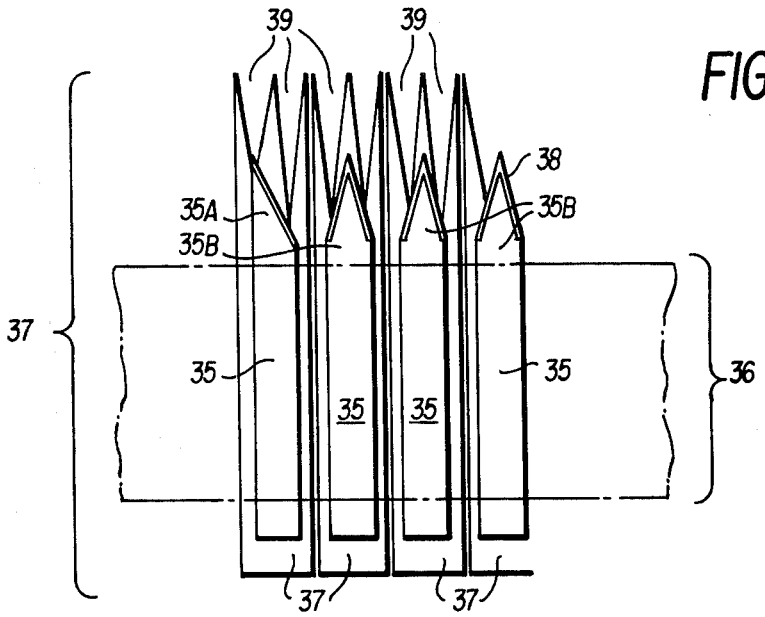
FIG. 9 is a view of portion of a power driven cutter blade 36 which is fixed to an endless-belt 37.

Referring now to FIG. 9, this shows an endless belt cutting blade. In this embodiment the toothed endless-belt blade consists of a large number of individual blade segments 35 which are joined on their upper surface to the underneath surface of an endless belt 36. The underneath surface of the blade segments move over and in contact with the upper surface of a flexible comb 37.

Each blade segment 35 has either a single-edged cutting head 35A or a double-edged cutting head 35B. A single-edged cutting head 35A is utilised when the endless belt 36 to which it is attached moves in one direction only - in the case of the embodiment illustrated in FIG. 9 that direction being to the right of the diagram. A double-edged cutting head 35B is utilised when the endless-belt to which it is attached oscillates laterally across the top of the comb-teeth.

For the purposes of illustration only, FIG. 9 shows both cutting heads 35A and 35B attached to the same endless belt 36. In practice only one of the two cutting neads 35A and 35B would be attached to any one endless-belt.

The cutting edges 38 of the blade segments 35 sever the fleece as it enters or after it has entered the gullets 39 of the comb 37. This is achieved by the cutting edges 38 respectively coming in contact with the upper edges of the sides of the gullets 39 of the comb 37 as the endless belt 36 to which the blade segments 35 are attached move laterally across the comb 37, either in a constant direction where a single-edged cutting head 35A is utilised or oscillating back and forth across the upper surface of the comb 37 when a double-edged cutting head 35B is utilised. By this means the fleece is severed by a very rapid series of scissor-like cutting strokes of the cutting heads 35A or 35B of the blade segments 35.

Figure 10:
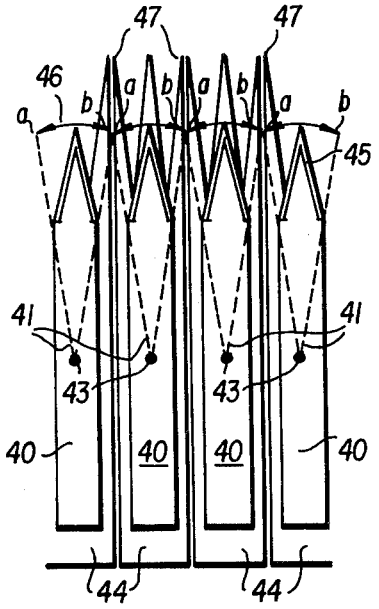
FIG. 10 is a view of portion of a toothed endless belt type cutting blade with individual teeth mounted in swivel fashion on the belt.

Referring now to FIG. 10, this shows another form of cutting blade. This is a swivel blade 40 consisting of a series of blades 10 which are each attached by a pin 41 at their mid-point or axis 43 to a flexible comb 44. The swivel blades 40 have two cutting edges 45 as shown in FIG. 10. As the swivel blades 40 swivel laterally the cutting edges 45 moving in contact with the upper surface of the comb 44 sever the fleece (after it has entered the gullet 42 of the comb 44). The severance of the fleece occurs as the cutting edges 45 respectively come in contact with the upper surface of the comb teeth as the head of the cutting blade 40 swivels back and forth in the arc *a–b.* By this means the fleece is severed by a very rapid series of scissor like lateral cutting strokes of the head of the cutter blades 40. The cutter blades 40 are causes to swivel on their respective pins 41 by means of drive wheels, cogs, belts, gears and the like (not shown) which are in turn connected to any convenient power source (not shown). Hinges 47 of the flexible comb 44 are also shown in the attached diagram.

This is a cognate application cognating my provisional patent applications Nos. PB 8084/74; PC1229/75 and PC /882/75.

The invention is not to be limited by the particular examples described above but only by the scope of the appended claims.

I claim:

1. A cutting unit for a shearing apparatus comprising a flexibly curvable comb having teeth on the intended concave surface thereof, the comb cooperating with a cutting means located behind and adjacent to the upper part of the teeth of the comb, and when the toothed surface of the comb is applied in a flexed condition to the body of an animal to be shorn, the comb and the co-operating cutting means conform as required to the contours of the animal's body and when forward propulsion force is applied to the shearing apparatus to propel same over the body of the said animal, this propulsion force simultaneously assists the cutting means to break or sever the fleece from the animal's hide.

2. The cutting unit as claimed in claim 1 wherein the cutting means is a flexible cutting blade.

3. The cutting unit as claimed in claim 1 wherein the cutting means is a hot-wire.

4. The cutting unit as claimed in claim 2 wherein the cutting means is itself in the form of an endless belt.

5. The cutting unit as claimed in claim 4 wherein the cutting means is a toothed endless belt provided with a number of cutting teeth.

6. The cutting unit as claimed in claim 5 wherein the cutting teeth are individually mounted on the comb for swivel movement of the said teeth.

7. The cutting unit as claimed in claim 1 wherein the cutting means comprises at least two cutting units joined together by a flexible axle in spaced apart relationship to each other.

8. The cutting unit as claimed in claim 1 incorporating at least one propelling cylinders made from traction producing material and providing the forward propulsion of the cutting unit.

9. A shearing apparatus comprising a housing, incorporating a cutting unit according to claim 1, in combination with propulsion means for applying propulsion to the cutting unit to propel same over the body of an animal to be shorn.

10. The shearing apparatus according to claim 9 wherein the propulsion means comprises at least one propelling cylinders made from traction producing material or incorporating traction producing protuberances, and providing or assisting the forward propulsion of the shearing apparatus or the cutting unit thereof.

11. A hand holdable shearing apparatus according to claim 9 including a motor adapted to drive the propelling cylinder by a belt drive and sprockets provided in the housing, the cutting means of the cutting unit being in the form of a rotatable moving hot-wire also drivable from the motor by means of a belt drive and sprockets.

12. The hand holdable shearing apparatus according to claim 9 comprising a motor adapted to drive the propelling cylinder, the cutting means of the cutting unit being in the form of an endless belt passing through the housing.

13. The hand holdable shearing apparatus according to claim 12 wherein the cutting means of the cutting unit is a hot-wire attached to the endless belt.

14. The hand holdable shearing apparatus according to claim 12 wherein the cutting means of the cutting unit is a toothed endless belt.

15. The hand holdable shearing apparatus according to claim 14 wherein the cutting means of the cutting unit are a series of blades mounted on a flexible comb in swivel manner.

16. A power drivable, high speed fleecing apparatus according to a cutting unit according to claim 1 together with means for applying power driving propulsion to the cutting unit to propel same over the body of an animal to be shorn.

17. The power drivable, high speed fleecing apparatus according to claim 16 wherein a number of propelling cylinders are joined together on a flexible axle at spaced intervals is provided to assist propulsion of the cutting unit over the body of an animal to be shorn.

18. The power drivable, high speed fleecing apparatus according to claim 16, comprising means for holding an animal to be shorn temporarily immobilised with its spine in a vertical position, means for positioning a flexible comb of a cutting unit according to claim 2, against the back and sides of the body of the said animal and another such cutting unit against the belly of said animal, the flexible comb of each said cutting unit being of sufficient length to cover the said back and sides of belly respective.

19. The cutting means when used in the cutting unit claimed in claim 1 comprising an endless belt provided with a number of cutting teeth affixed thereto.

20. The cutting means when used in the cutting unit claimed in claim 19 wherein the cutting means of the cutting unit are a series of blades mounted on the comb in swivel manner.

21. The cutting means when used in the cutting unit claimed in claim 1 comprising a flexible blade in the form of an endless belt or attached to a non-cutting endless belt.

22. The cutting means when used in the cutting unit claimed in claim 1, comprising a hot-wire in the form of an endless belt or attached to a non-cutting belt.

* * * * *